United States Patent [19]

Fontana

[11] 4,259,857

[45] Apr. 7, 1981

[54] KEY-RETAINING LOOP FOR A KEY CASE

[75] Inventor: Giampiero Fontana, Milan, Italy

[73] Assignee: Valextra S.p.A., Milan, Italy

[21] Appl. No.: 2,172

[22] Filed: Jan. 9, 1979

[30] Foreign Application Priority Data

Jun. 29, 1978 [IT] Italy ..... 22208/78[U]
Sep. 15, 1978 [IT] Italy ..... 22278/78[U]

[51] Int. Cl.[3] ..... A44B 15/00
[52] U.S. Cl. ..... 70/456 B
[58] Field of Search ..... 70/456 B, 456 R, 459; 24/3 K; 150/40

[56] References Cited

U.S. PATENT DOCUMENTS 1,742,915 1/1930 Ingersoll ..... 70/456 B
2,093,326 9/1937 Legat ..... 70/456 B

FOREIGN PATENT DOCUMENTS 1442197 5/1966 France ..... 70/456 B
697159 9/1953 United Kingdom ..... 70/456 B

*Primary Examiner*—Robert L. Wolfe
*Attorney, Agent, or Firm*—Stevens, Davis, Miller & Mosher

[57] ABSTRACT

A key retaining loop to be removably inserted in a key case is disclosed, the improvement consisting in the provision, on the legs of the openable loop, of wings, engaging snappingly a recess formed in a sleeve to be fastened to the key case. An alternative embodiment has the legs of the loop screw-threaded for engaging the internal tapping of the sleeve aforesaid.

Simplicity and reliability of use are thus achieved.

4 Claims, 4 Drawing Figures

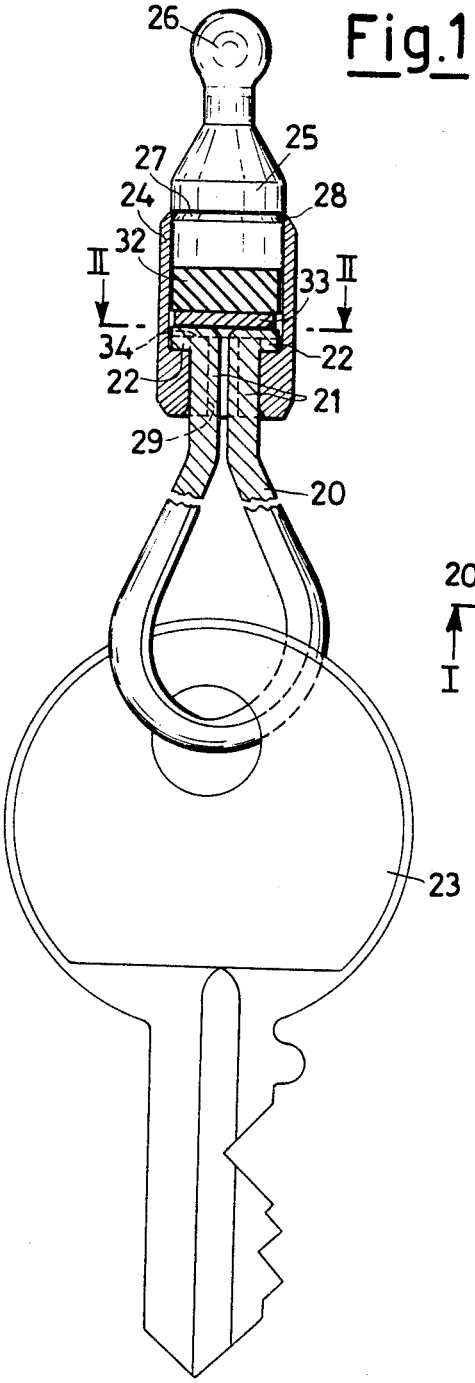
Fig.1
Fig.2
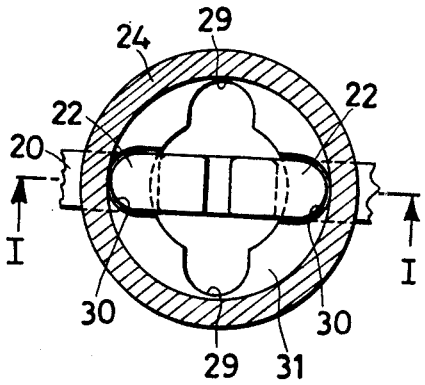

KEY-RETAINING LOOP FOR A KEY CASE

This invention relates to a key-retaining loop for a key case, of the kind intended to become linkably and releasably engaged by a supported mechanism borne by a key case and housed therein, said case being made of a stiff material such as skin ana the like.

Said key cases generally employ key-retaining loops made as a single piece each, comprising a rigid shank from which a hook like portion extends which is resiliently flexible and the free end of which rests against said hook like portion. The key is thus inserted by forcibly spreading the hook like portion from the shank so as to slip the key bow thereon. The free end of the shank, in addition, has an enlarged header which is adapted to be slidably and removably bound to an arcuate slot on the supporting member in the key case.

Loops and key cases of the kind referred to above are disclosed, for example, in the U.S. Pat. Nos. 4,033,162 and 4,085,602.

Key-retaining loops of the kind referred to above have, however, the shortcoming that the introduction of a key in them is not entirely convenient and must be effected with a certain skill if it is desired to dispense with the use of emergency auxiliary tools for spreading the resiliently flexible hook-like portion from the shank.

An object of the present invention is to do away with the drawback outlined above and, to this purpose, according to the invention, it has been envisaged to provide a key-retaining loop characterized in that it comprises, in combination: a resiliently flexible split ring, from the free ends of which there extend two substantially parallel tail pieces and a rigid shank having an enlarged header, means of mutual stable but releasable engagement being provided between said tail pieces and said shank.

Said means of engagement between the ring and the shank can be, for example, in the form of a bayonet-coupling.

The bayonet coupling may comprise a sleeve which extends axially from the shank and a couple of confronting projections which extend radially from the ends of the ring tail pieces, said projections being capable of being inserted axially, through corresponding grooves, and to become engaged, after their rotation through a certain angle, by abutment means formed internally of said sleeve, yieldable resilient detent means acting upon said projections axially so as to keep them engaged by said abutment means.

Preferably, such abutment means are formed by a couple of notches which are diametrically opposite and into which the projections of the tail pieces snap as urged by said resilient means.

The means of engagement between the ring and the shank can also be embodied by screw-threading the ring tail pieces and the sleeve, externally and internally, respectively: if so, the two tail pieces are made slightly spaced apart, so as to enable a key to be conveniently introduced therebetween, whereafter the tail pieces are approached by slightly squeezing them with the fingers in order to be screwably locked within the shank sleeve.

In this case, moreover, preferably but not compulsorily, the shank header is provided with a diametrical groove which is adapted to be engaged by a screw driver with a certain torque for locking the sleeve onto the screw-threaded tail pieces.

The functional and structural features of the invention as well as its advantages over the prior art will become still more apparent from a scrutiny of the ensuing exemplary description aided by the accompanying drawings on an enlarged scale, wherein:

FIG. 1 is a cross-sectional view taken along the line I—I of FIG. 2, showing a first embodiment of the invention.

FIG. 2 is a cross-sectional view taken along the line II—II of FIG. 1.

Figure 4:
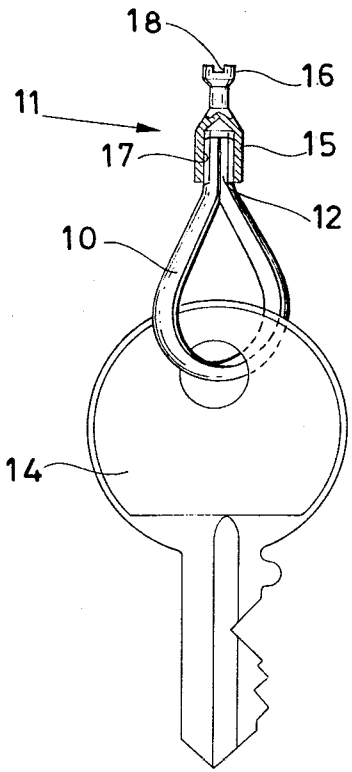
FIG. 4 is a partially sectioned closeup view of the loop of FIG. 1 in the assembled position.

With reference to FIGS. 1 and 2 of the drawings, the key-retaining loop in question comprises a split ring 20, made of a resiliently flexible material, from the free ends of which there extend two parallel tail pieces 21 which are terminated by confronting radial protrusions 22.

The tail pieces 21, once a key 23 has been introduced in the loop 20, can be engaged, by the projections 22, with a sleeve 24 fastened to a shank 25 having a header 26. The sleeve 24 is affixed within a circumferential recess 27 of the shank 25 by a bead 28.

The projections 22 can axially be introduced into the sleeve 24 through grooves 29 and can be engaged within a couple of notches 30 confronting one another and formed on a restricted section 31 of the sleeve 24. This engagement is encouraged and stabilized by the action of a pad 32 of a resiliently yieldable material (such as rubber) which thrusts axially the projections 22, a metallic friction slug 33 being inserted therebetween.

To effect the engagement between the loop and the sleeve, it is required, first, to push the loop 20 against the bias of the pad 32 until bringing the projections 22 to a level higher than that of the step 34: then, the loop can be rotated through 90° and the bias of the resilient pad 32 causes the projections 22 to snap into the notches 30.

The reverse operations effect the release of the two parts.

Thus, a key-retaining loop has been devised, which is simple and reliable in use and permits to engage and release the keys without using any special tool therefor.

Figure 3:
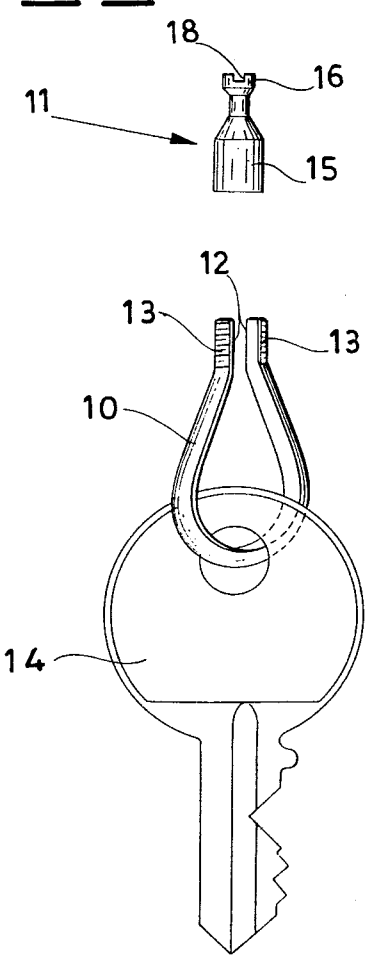
FIG. 3 is an exploded view showing an alternative embodiment of the invention.

In the alternative embodiment shown in FIGS. 2 and 3 of the drawings, the tail pieces 12 of the loop 10 have, characteristically, an external screw-thread 13. Preferably, the tail pieces 12 are slightly spaced apart so as to facilitate the insertion of a key bow 14 therebetween.

The shank 11 is rigid and has a sleeve 15 and, at the end away of 15, a header 16. The sleeve 15 is tapped, as at 17, correspondingly to the screw-thread 13 on the tail pieces 12 of the loop 10. The header 16 has a diametrical groove 18.

The key-retaining ring of the invention is used simply in the following manner.

The key 14 is first introduced in the loop 10, separate from the shank 11, as clearly shown in FIG. 1 of the drawings. Then, the tail pieces 12 are brought towards one another by a slight pressure of the fingers and the sleeve 15 of the shank 11 is screwed thereonto, so that the key 14 is reliably retained within the loop. The screwable engagement of the sleeve 15 onto the tail pieces 12 can be made completely manually or, if it is desired to apply a stronger torque, it is possible to complete the work by a screw driver inserted in the groove 18 of the header 16.

The loop with the key retained thereby can then be mounted on the supporting device of the relative key case, for example, of the kind disclosed and shown in the U.S. Pat. Nos. 4,033,162 and 4,085,602.

I claim:

1. A key-retaining loop of the kind comprising a resiliently flexible split ring, a shank extending therefrom terminated by an enlarged header for mounting linkably and removably the loop in a supporting device housed within a key case, and stable and releasable mutual engagement means provided between said ring and said shank, said engagement means have the form of a bayonet coupling.

2. The loop according to claim 1, wherein said bayonet coupling comprises a sleeve extending axially from the loop shank, said loop being terminated by two parallel tail pieces having a couple of end radial projections confronting one another which are adapted to be inserted axially in said sleeve through corresponding grooves and to engage by rotation through a certain angle abutment means formed internally of the sleeve, resiliently yieldable retaining means being provided which act upon said projections axially in the sense of holding them in engagement with said abutment means.

3. The loop according to claim 2, wherein said abutment means are formed by a couple of diametrically opposite notches into which the tail piece projections snap as biased by said resilient means.

4. A key-retaining loop of the king comprising a resiliently flexible split ring, a shank extending therefrom terminated by an enlarged header for mounting linkably and removably the loop in a supporting device housed within a key case, and stable and releasable mutual engagement means provided between said ring and said shank, said engagement means being screwable and comprising a tapped sleeve axially extending from the loop shank and two externally screw-threaded tail pieces extending from the split ring loop.

* * * * *